US006294969B1

(12) United States Patent
Matsuo et al.

(10) Patent No.: US 6,294,969 B1
(45) Date of Patent: Sep. 25, 2001

(54) DIELECTRIC FILTER AND RF APPARATUS EMPLOYING THEREOF

(75) Inventors: Michiaki Matsuo; Hiroyuki Yabuki, both of Kanagawa; Morikazu Sagawa, Tokyo, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/436,123

(22) Filed: Nov. 8, 1999

(30) Foreign Application Priority Data

Nov. 6, 1998 (JP) ..... 10-315881

(51) Int. Cl.[7] ..... H01P 1/20; H01P 7/04; H01P 5/12

(52) U.S. Cl. ..... 333/206; 333/202; 333/222; 333/134

(58) Field of Search ..... 333/202, 206, 333/222, 134

(56) References Cited

U.S. PATENT DOCUMENTS

| | | | | |
|---|---|---|---|---|
| 5,764,118 | * | 6/1998 | Saito et al. | 333/206 |
| 5,999,070 | * | 12/1999 | Endo | 333/206 |
| 6,002,309 | * | 12/1999 | Nishijima et al. | 333/206 |

FOREIGN PATENT DOCUMENTS

| | | |
|---|---|---|
| 0 869 572 | 3/1998 | (EP) . |
| 0 951 089 | 10/1999 | (EP) . |
| 5-63411 | 3/1993 | (JP) . |
| 5-226909 | 9/1993 | (JP) . |
| 6-90104 | 3/1994 | (JP) . |
| 06268413 | 9/1994 | (JP) . |
| 07183709 | 7/1995 | (JP) . |

OTHER PUBLICATIONS

European Search Report, application No. 99122156.5, dated Jan. 20, 2000.

* cited by examiner

*Primary Examiner*—Robert Pascal
*Assistant Examiner*—Patricia T. Nguyen
(74) *Attorney, Agent, or Firm*—Ratner & Prestia

(57) ABSTRACT

A dielectric filter includes a dielectric block having multiple through holes which are created in parallel and grooves which are created around the opening of the through holes. A conductor is formed inside the grooves and the through holes. The inside conductors and in-groove conductors are connected at the opening of the through hole surrounded with the groove. The inside conductors and an outside conductor are connected at a second end. The opening of the through hole is formed inside an open-circuit end of the dielectric block.

38 Claims, 7 Drawing Sheets

DIELECTRIC FILTER AND RF APPARATUS EMPLOYING THEREOF

FIELD OF THE INVENTION

The present invention relates to the field of dielectric filters employed in a range of radio communications apparatuses and broadcasting equipment in the several hundred MHz frequency bands.

BACKGROUND OF THE INVENTION

Today, RF apparatuses used in mobile communications and broadcasting are rapidly becoming smaller and lighter. Coaxial resonators made of dielectric materials with high dielectric constant and low loss are extensively used as filters in RF apparatuses, which are required to be small and light. Such dielectric coaxial resonators are also made smaller by designing resonator shapes, for example, to change the characteristic impedance of the line stepwise, as well as using dielectric materials with large specific inductive capacity.

Next, a conventional dielectric filter is described. FIG. 7 is a cutaway sectional view of a conventional dielectric filter. As shown in FIG. 7, through holes 2A and 2B are created on a rectangular dielectric block 1, and the inside of the through holes 2A and 2B is metallized with inside conductors 4A and 4B. The periphery of the dielectric block 1 is metallized with an outside conductor 5. The inside conductors 4A and 4B are connected to the outside conductor 5 through one of openings in through holes 2A and 2B, respectively. An I/O electrode 7A is created by providing an isolated electrode on a part of the outside conductor 5. The I/O electrode 7A is electromagnetically coupled with the inside conductor 4A, and is connected to an external circuit. Another I/O electrode 7B (not shown in FIG. 7) is provided on a cut part, opposing the I/O electrode 7A. In the above configuration, a resonator is formed in the through holes 2A and 2B, and the dielectric filter shown in FIG. 7 operates as a two-step filter.

If the diameter of a through hole is stepped to configure a coaxial resonator with a larger hole diameter at the open-circuit end than that at the short-circuit end where the inside conductor and outside conductor are connected, capacitance for the outside conductor 5 is added to the line comprising the inside conductors 4A and 4B, enabling the shortening of the resonator length. In other words, the characteristic impedance of the resonance line formed by inside conductors 4A and 4B is stepped. By making the characteristic impedance at the open-circuit end lower than that at the short-circuit end, the resonator length can be made shorter than that of resonators with fixed characteristic impedance, thus allowing the overall size of the filter to be reduced.

However, in the conventional dielectric filter shown in FIG. 7, the resonator length can only be reduced to about half the size of a resonator with fixed characteristic impedance. Accordingly, no further reduction in size is feasible. At present, the conventional dielectric filter shown in FIG. 7 can be made several millimeters square for the 800 MHz band by using high dielectric material. This type of dielectric filter is often used in the RF section of mobile phones using this frequency band. For other RF apparatuses using lower frequency bands than 800 MHz, which require larger dielectric filters, helical filters are commonly employed instead of dielectric filter to reduce size. Since dielectric filters are inexpensive and easy to manufacture, and have several specific advantages such as low loss and high power resistance, a reduction in size would allow them to be employed in low-frequency band apparatuses.

The present invention aims to solve the problems described above and provide a small, light, and low-loss dielectric filter, compared to conventional ones, which are easily manufacturable and are particularly used at low frequency bands from VHF to UHF.

SUMMARY OF THE INVENTION

A dielectric filter of the present invention comprises a dielectric block; plural parallel through holes created in the dielectric block; at least one groove surrounding an opening of the through hole at the first end, one end of two ends in which one of them is at least open; an in-groove conductor made by forming a conductor inside the groove; an inside conductor made by forming conductor inside each of the through hole; an outside conductor made by covering the periphery of the dielectric block with a conductor; and an I/O electrode connected to an external circuit and electromagnetically coupled with the inside conductor. The outside conductor and inside conductor are connected at a second end at which each of the through hole is open, and the in-groove conductor and inside conductor are connected at the opening of the through hole surrounded with the groove. The opening is made inside the first end of the dielectric block.

With the above configuration, the length of a resonator formed by the inside conductor may be significantly reduced, enabling to achieve smaller filter, as a whole, compared to a conventional configuration.

In the dielectric filter of the present invention, the groove provided around the opening of the through hole forms a line with one short-circuit end, and this line is loaded in series to a line resonator formed by the inside conductor. In other words, the line formed by the groove has shorter wavelength than the quarter wavelength. Accordingly, an inductance element is loaded in series, and impedance of the line formed at the open-circuit end is reduced to add large capacitance, enabling to significantly reduce resonance frequency. In other words, inductance and capacitance may be increased with a fixed resonator length. If the resonator frequency is fixed, the resonator length can be significantly shortened, enabling to drastically reduce the size of the entire filter. Furthermore, since the resonance line formed of the inside conductor and in-groove conductor formed in the through hole and groove is created inside the outside conductor, spreading of the electric field to outside of the outside conductor can be prevented. High no-load Q for the resonator can be assured, enabling to configure a low-loss filter.

By reducing the size of the resonator as described above, multiple resonance frequencies are differed from an odd-numbered multiple of the fundamental frequency. Accordingly, harmonic of the fundamental frequency may be suppressed when the dielectric filter of the present invention is applied to an output filter of non-linear circuits such as power amplifiers.

Still more, the dielectric block with through holes and grooves can be integrally molded. Since the connection of the inside conductor and in-groove conductor is provided inside the open-circuit end, the filter may be formed by integrally molding dielectric ceramics into the shape of the dielectric filter of the present invention using molds. The entire face of the dielectric ceramics is coated with a metal film, and the end on which the groove is formed is ground to create the open-circuit end. Then the I/O electrode is formed. With these processes, the dielectric filter of the present invention can be easily manufactured, which is suitable for mass production.

In the dielectric filter of the present invention, the groove is formed concentric to the through hole or parallel to the periphery of the dielectric block. Concentric grooves facilitate its molding and realize rigid structure. Grooves parallel to the periphery of the dielectric block achieve further larger capacitance to the open-circuit end. This enables to further shorten the resonator length, and thus further reduce the size of the filter.

Furthermore, plural grooves are created around the opening of the through hole in the dielectric filter of the present invention. This enables to load further larger inductance in series to the line resonator formed by inside conductor. Thus, the resonator length may be further reduced, and accordingly the size of the filter is further reduced.

The groove in the dielectric filter of the present invention may be tapered. This enables to create a deeper groove, thus further reducing the resonator length. This also prevents peeling of the conductor formed in the groove, reducing disorder of distribution of the electromagnetic field caused by the discontinuity of the connection. Deterioration of the no-load Q is also preventable. The opening area can also be made wider, offering advantages in processing, such as easier processing and manufacturing of the groove.

In the dielectric filter of the present invention, multiple resonance frequencies of each line resonator formed by multiple through holes are adjusted by whether to provide grooves and by changing the depth of each groove. By combining such resonators, the dielectric filter having favorable spurious characteristics without undesired passband may be configured.

A RF apparatus of the present invention includes high frequency circuits, RF communications apparatuses, and broadcasting equipment employing the above dielectric filter. With the advantage of the dielectric filter, such circuits and equipment may be made smaller with lower loss.

DESCRIPTION OF THE PREFERRED EMBODIMENTS

First Exemplary Embodiment

Figure 1A:
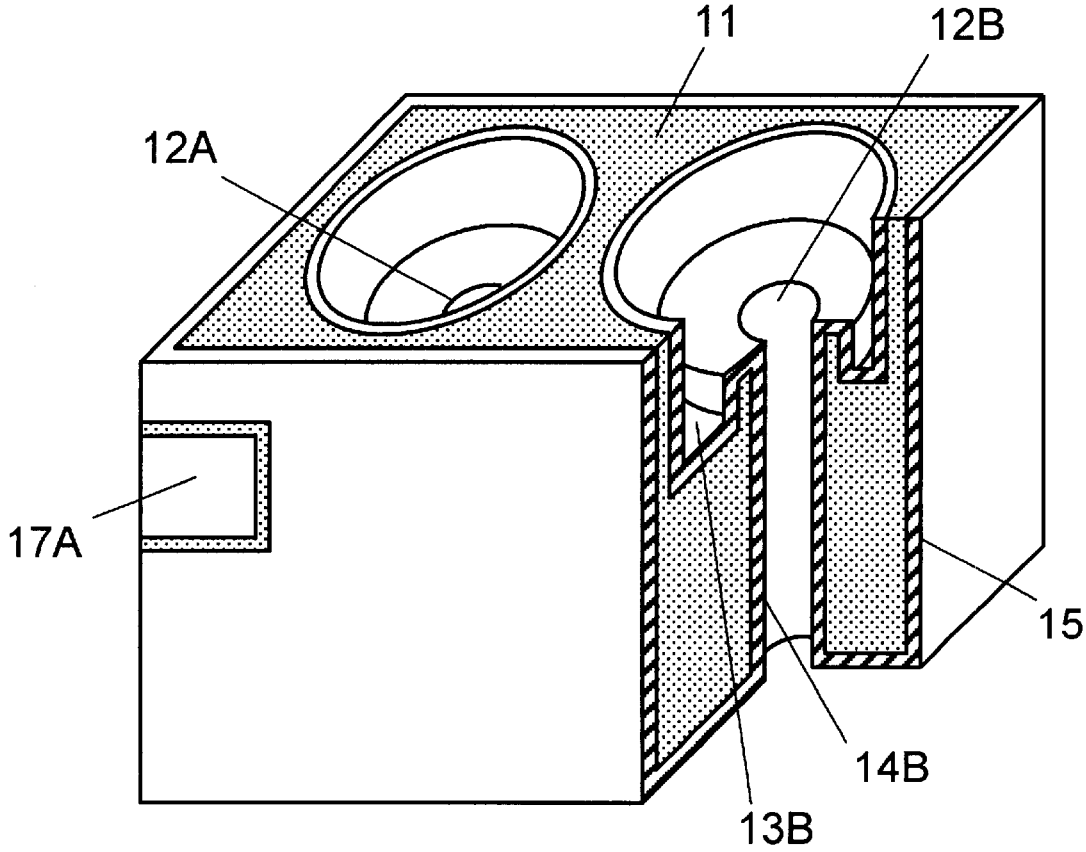
FIG. 1A is a perspective cutaway view of a dielectric filter in accordance with a first exemplary embodiment of the present invention.
Figure 1B:
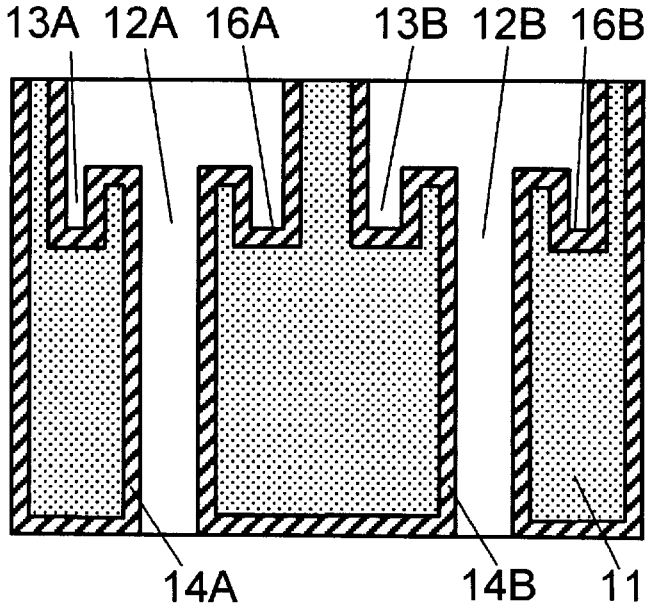
FIG. 1B is a sectional view of the dielectric filter in accordance with the first exemplary embodiment of the present invention.

A dielectric filter in accordance with a first exemplary embodiment of the present invention is described with reference to FIGS. 1A and 1B. FIG. 1A is a perspective cutaway view of the dielectric filter showing the configuration of an inside conductor and groove for easier understanding. FIG. 1B is a sectional view of the dielectric filter taken along each through hole. As shown in FIGS. 1A and 1B, two through holes 12A and 12B are created in a dielectric block 11. Grooves 13A and 13B are concentrically created around the top opening of the through holes 12A and 128. Inside conductors 14A and 14B are metallized inside the through holes 12A and 12 respectively. An outside conductor 15 is metallized around the dielectric block 11. In-groove conductors 16A and 16B are metallized inside the grooves 13A and 13 respectively. An I/O electrode 17A is electromagnetically coupled to the inside conductor 14A and connected to an external circuit.

The inside conductors 14A and 14B are connected to the outside conductor 15 at the bottom face of the dielectric block 11, and connected to the in-groove conductors 16A and 16B at the top opening of the through holes 12A and 12B. The in-groove conductors 16A and 16B and the outside conductor 15 are not directly connected to each other and respectively form open-circuit ends. In FIGS. 1A and 1B, two coaxial line resonators are configured by the inside conductors 14A and 14B. Inductance formed by the in-groove conductors 16A and 16B is loaded in series to the coaxial line resonator. With provision of the grooves 13A and 13B, the distance between the outside conductor 15 and in-groove conductors 16A and 16B is narrowed at the open-circuit end of the coaxial line resonator, increasing the capacitance formed by the outside conductor 15. The above effect enables the reduction of the length of the resonator and thus the size of the filter. By applying the present invention, the resonator length may be shortened to about ⅓ the size of a conventional dielectric filter having the fixed characteristic impedance for the resonance line. In addition, the concentric grooves 13A and 13B facilitate its manufacture and realize a rigid structure which is resistant to external forces.

The opening at which the inside conductors 14A and 14B and in-groove conductors 16A and 16B are connected is provided inside the open-circuit end, i.e., inside the dielectric block. This prevents leakage of any radiation electric field to outside of the outside conductor 15 due to the discontinuity of characteristic impedance at the connection of the inside conductor and in-groove conductor. Thus, deterioration of the no-load Q of the resonator is prevented, realizing a low-loss filter.

Furthermore, by reducing the size of the resonator, multiple resonance frequencies of each resonator can be differed from an odd-numbered multiple of the fundamental frequency, realizing a filter with good higher harmonic suppression characteristics. The dielectric filter also has good power resistance. Accordingly, the dielectric filter of the present invention is suitable for employment as an output filter for non-linear circuits such as power amplifiers. In addition, polarization in the attenuation characteristics of the filter can be expected due to unbalanced electro-coupling and magneto-coupling at the connection of resonators, which is caused by changes in the characteristic impedance.

In the filter in this exemplary embodiment, the dielectric block with through holes and grooves can be integrally molded. More specifically, dielectric ceramics can be formed to the shape of the dielectric filter of the present invention using molds in the manufacture of the filter because the connections between the inside conductors and in-groove conductors are provided inside the open-circuit end. Then, the entire face of the dielectric ceramic is coated with a metal film, and the open-circuit end is formed by grinding the open face on which the groove is formed. The I/O electrode is then formed. Using these simple processes, the dielectric filter of the present invention can be easily manufactured. Accordingly, the filter of the present invention has a structure suitable for mass production at low cost.

The first exemplary embodiment enables the reduction of the resonator length by adding inductance formed by the in-groove conductor and capacitance generated by the groove structure to the inside conductor which is the resonance line. At the same time, this configuration prevents deterioration of the no-load Q, thus realizing a small and low-loss dielectric filter.

Second Exemplary Embodiment

Figure 2:
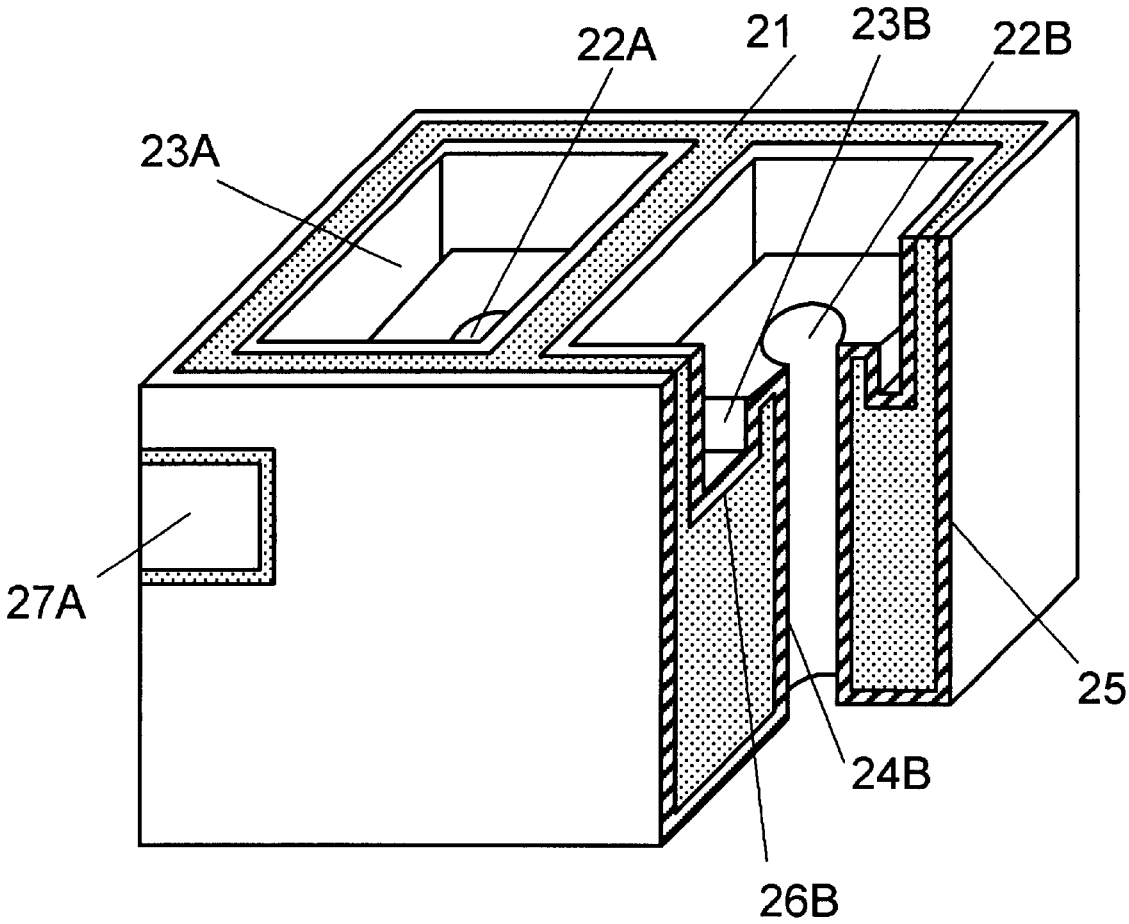
FIG. 2 is a perspective cutaway view of a dielectric filter in accordance with a second exemplary embodiment of the present invention.

FIG. 2 shows a perspective cutaway view of a dielectric filter in accordance with a second exemplary embodiment of the present invention showing the configuration of the inside conductor and groove for easier understanding. It differs from the first exemplary embodiment of the present invention in that a rectangular groove is created around the opening of the through hole in parallel to the periphery of the dielectric block.

The operation of the dielectric filter as configured above is described with reference to FIG. 2. The basic operation is the same as for the first exemplary embodiment. In this exemplary embodiment, large capacitance is achievable between an in-groove conductor 26B and an outside conductor 25 by providing grooves 23A and 23B around the top opening of through holes 22A and 22B in parallel to the periphery of the dielectric block 21. Since this capacitance is added in parallel to a coaxial line resonator formed by an inside conductor 24B, the resonator length can be further reduced compared to the first exemplary embodiment.

As described above, in the second exemplary embodiment of the present invention, grooves are provided in parallel to the periphery of the dielectric block. Thus, the resonator length can be significantly reduced by adding large capacitance to the inside conductor forming the resonator line. This enables to achieve a small and low-loss dielectric filter applicable to further low frequency bands, compared to the first exemplary embodiment.

Third Exemplary Embodiment

Figure 3:
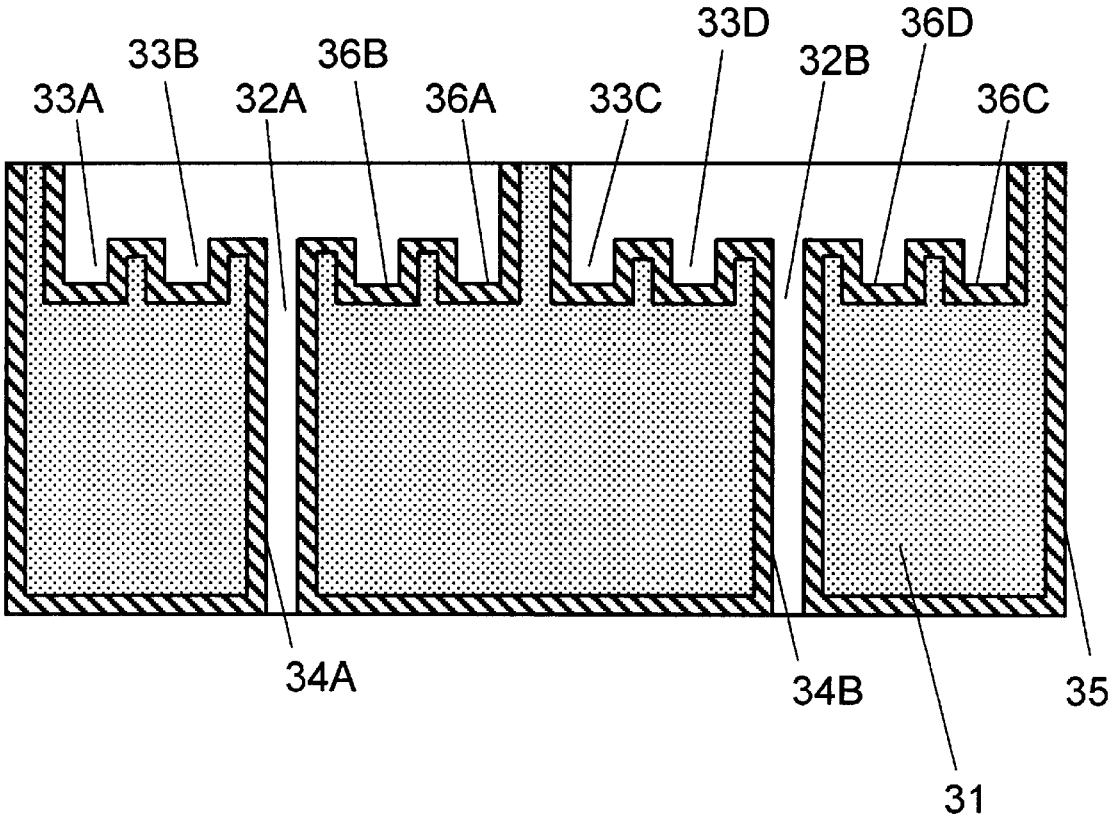
FIG. 3 is a sectional view of a dielectric filter in accordance with a third exemplary embodiment of the present invention.

FIG. 3 shows a sectional view of a dielectric filter in accordance with a third exemplary embodiment of the present invention. It differs from the first exemplary embodiment of the present invention in that two grooves are created respectively around the top opening of the through holes 32A and 32B.

The operation of the dielectric filter as configured above is described with reference to FIG. 3. The basic operation is the same as for the first exemplary embodiment. In this exemplary embodiment, inductance achieved by in-groove conductors 36A, 36B, 36C, and 36D can be made larger by providing two grooves each around the top opening of the through holes 32A and 32B. By loading the inductance in series to a coaxial line resonator formed by the inside conductors 34A and 34B, the resonator length may be further shortened than the first exemplary embodiment. More specifically, the resonator length of the filter in this exemplary embodiment can be shortened to ⅓ or below compared to the conventional dielectric filter with fixed characteristics impedance for the resonator line.

As described above, the third exemplary embodiment enables to add large inductance formed by the in-groove conductors to the inside conductor, which is the resonance line, by providing two or more grooves on each through hole. Thus, the resonator length can be significantly reduced, realizing a small and low-loss dielectric filter applicable to further lower frequency bands than the first exemplary embodiment.

FIG. 3 shows an example of providing two grooves respectively, but the same effect of reducing the length may be achieved to make the filter smaller by providing three or more grooves.

Fourth Exemplary Embodiment

Figure 4:
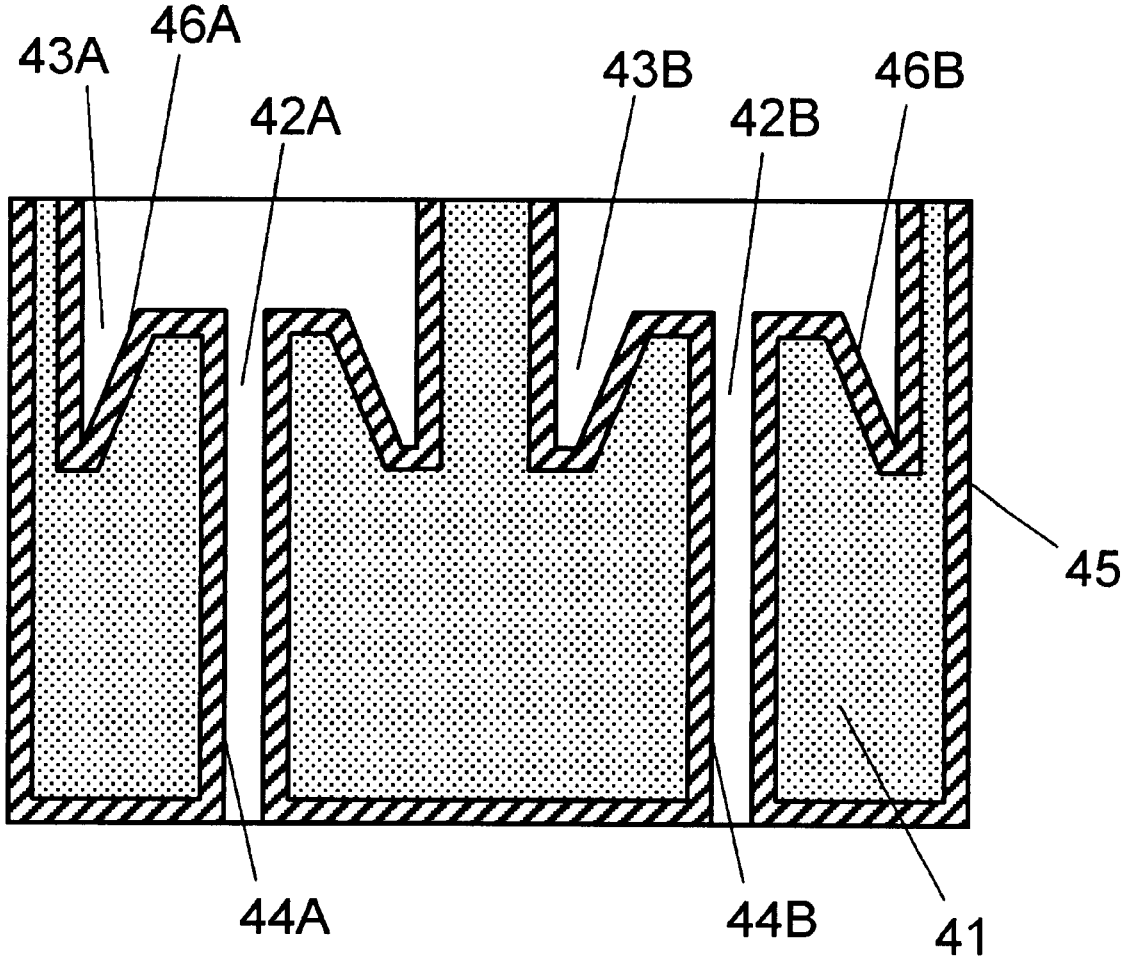
FIG. 4 is a sectional view of a dielectric filter in accordance with a fourth exemplary embodiment of the present invention.

FIG. 4 is a sectional view of a dielectric filter in accordance with a fourth exemplary embodiment of the present invention. It differs from the first exemplary embodiment in that the groove is tapered in its depth direction.

The operation of the dielectric filter as configured above is described next with reference to FIG. 4. The basic operation is the same as for the first exemplary embodiment. In this exemplary embodiment, a deeper groove may be formed by tapering grooves 43A and 43B in their depth direction around the top opening of the through holes 42A and 42B, enabling to further reduce the resonator length. In addition, tapered grooves facilitate metallization of an in-groove conductor, and at the same time, form the structure of the conductor difficult to be peeled off. In addition, the structure of gradually changing impedance reduces disorder of the distribution of the electromagnetic field caused by the discontinuity in the connection between the inside conductor and in-groove conductor, thus enabling to prevent deterioration of the no-load Q. The fourth exemplary embodiment also enables to broaden the opening area, facilitating processing and manufacturing of grooves. Since this structure facilitates mold release without damaging the shape when the dielectric block is molded, it has large advantages in processing such as improvement of the manufacturing yield rate.

Accordingly, the fourth exemplary embodiment realizes a small and low-loss dielectric filter which can be easily processed and manufactured by tapering the groove in the depth direction.

Fifth Exemplary Embodiment

Figure 5:
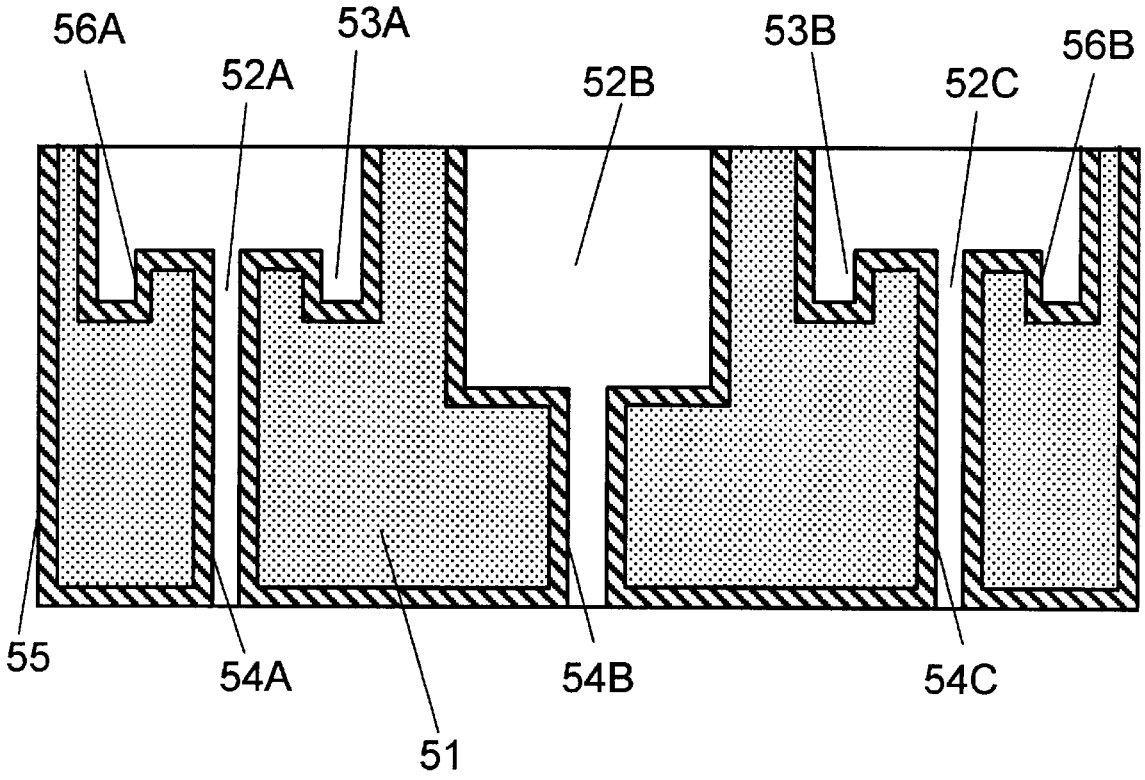
FIG. 5 is a sectional view of a dielectric filter in accordance with a fifth exemplary embodiment of the present invention.

FIG. 5 shows a sectional view of a dielectric filter in accordance with a fifth exemplary embodiment of the present invention. It differs from the first exemplary embodiment in that a three-step filter is configured by providing three through holes, and that no groove is provided around the top opening of the second through hole.

The operation of the dielectric filter as configured above is described with reference to FIG. 5. The basic operation is the same as for the first exemplary embodiment. A three-step filter is configured in this exemplary embodiment. A second-step resonator has a conventional structure formed by an inside conductor 52B Resonators formed respectively by connecting in-groove conductors 56A and 56B, formed around the opening of through holes 52A and 52C, to inside conductors 54A and 54C are first- and third-step resonators. Accordingly, a three-step filter is configured. In general, if multiple resonators with the same structure are used in a multi-step filter, an undesired passband is generated in the multiple resonance frequencies of the resonator. By configuring the filter with a combination of resonators with different structures in accordance with this exemplary embodiment, a filter with preferable spurious characteristics, which does not generate any undesired passbands, is achievable. FIG. 5 shows an example of the use of a resonator without a groove for the second-step filter. However, the present invention is not limited to this structure. Since the structure of the filter in the present invention enables the adjustment of the multiple resonance frequencies by changing dimensions such as groove depth and width, the same effect is achievable by employing small resonators provided with in-groove conductors for each step-resonator in the multi-step filter and by varying the groove depth and width.

As configured above, a multi-step filter in the fifth exemplary embodiment combines step-resonators with and without in-groove conductor in a multi-step filter, or step-resonators with different groove depths or widths in each stage, realizing a dielectric filter with preferable spurious characteristics.

In the above exemplary embodiments, an example of a filter with a two-step or three-step structure is described. It is apparent that the same structure is achievable with four-step or more filters. The figures show formation of the I/O electrode by an isolated electrode in the outside conductor. Other structures such as provision of an electrode on the open-circuit end are applicable. As long as the electrode is configured to electromagnetically couple with the first- and last-step resonators, the dielectric filter may be operated.

Sixth Exemplary Embodiment

The present invention provides an inexpensive and easily manufactured dielectric filter with low loss whose small size allows it to be employed from the VHF band to the UHF band. Accordingly, a range of high frequency circuits and equipment may be manufactured which exploit the characteristics of the present invention. In particular, the effect of the small size of the filter of the present invention is effectively demonstrated by applying it to filters of mobile phones, the RF section of RF apparatuses, typically mobile terminals with PDA (personal digital assistants) for data communications as well as in telephones, and circuits of branching filters and antenna duplexers.

Figure 6:
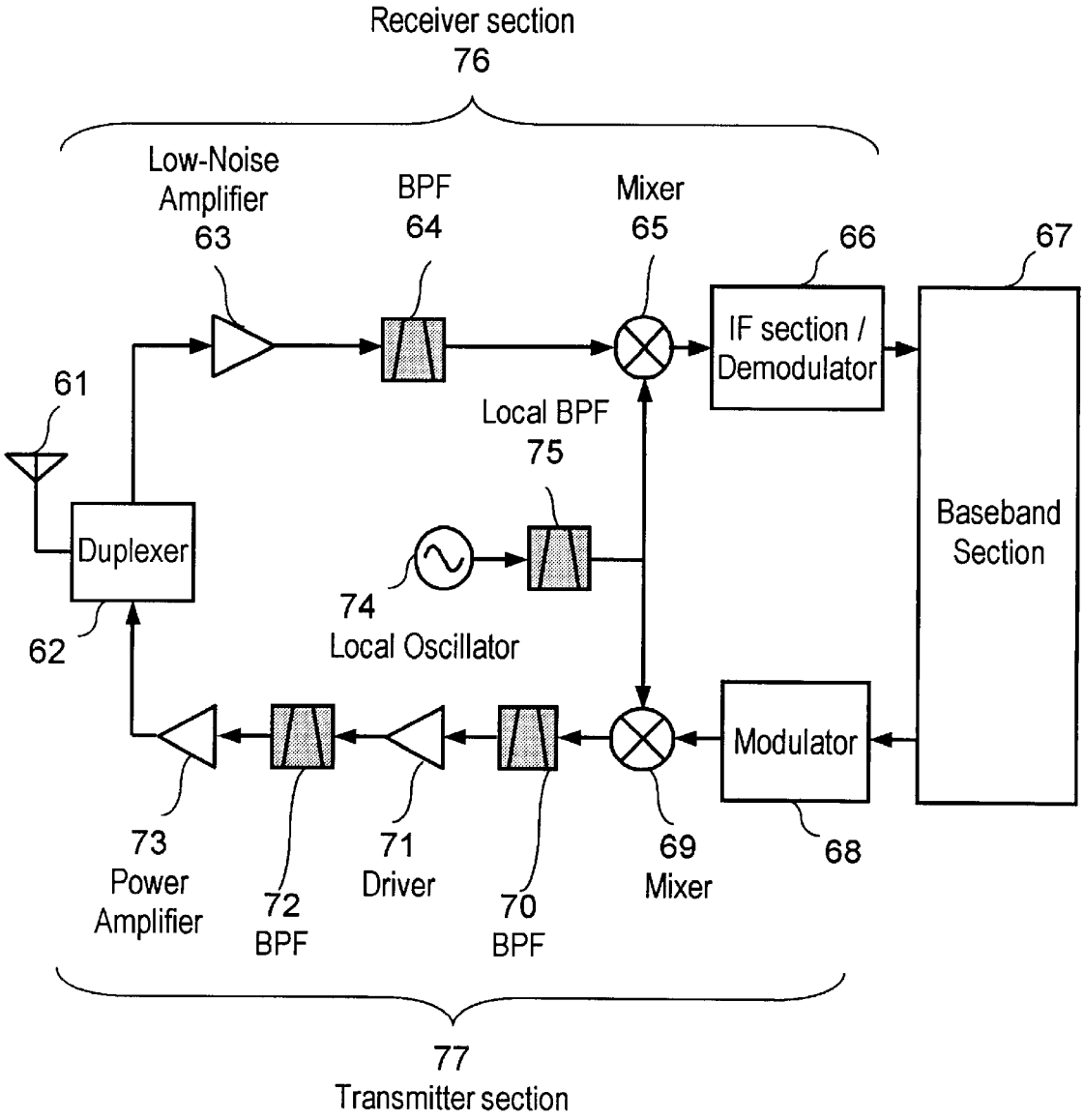
FIG. 6 is a block diagram of a RF section in a RF apparatus in accordance with a sixth exemplary embodiment of the present invention.
Figure 7:
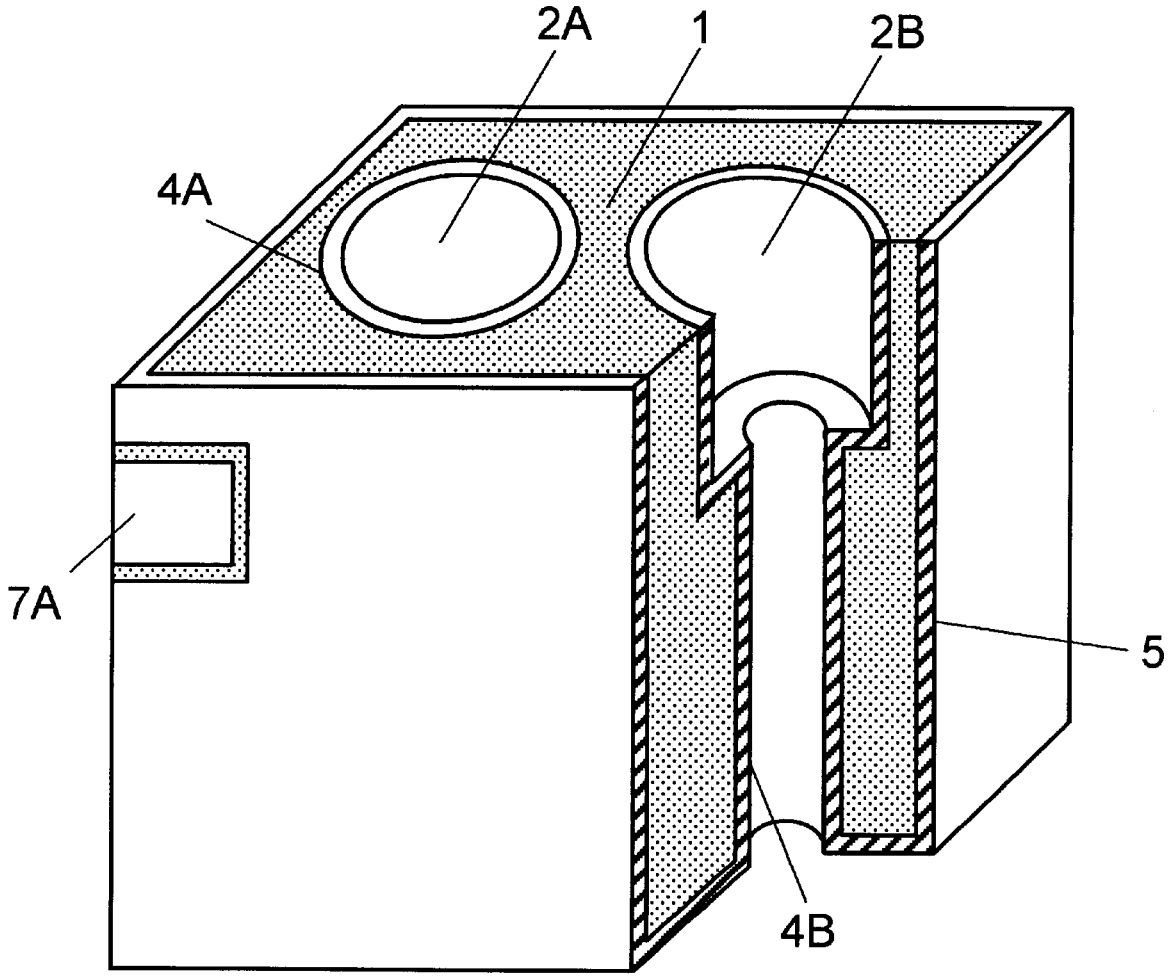
FIG. 7 PRIOR ART
FIG. 7 is a perspective view of a dielectric filter of the prior art.

FIG. 6 is a block diagram of an RF apparatus in accordance with a sixth exemplary embodiment of the present invention. FIG. 6 shows the RF section of a typical RF apparatus including a transmitter section 77 and a receiver section 76. Signals received by an antenna 61 are amplified by a low-noise amplifier 63 through an antenna duplexer 62, and a BPF (band pass filter) 64 takes out signals in a specified frequency band. A mixer 65 mixes these signals with signals from a local oscillator 74 after passing a local BPF 75 to convert signals to intermediate frequencies. Signals converted to intermediate frequencies are decoded at an IF section/demodulator 66, and input to a baseband section 67. Transmitting signals from the baseband section 67 are modulated by a modulator 68 to be mixed with signals from the local oscillator 74 after passing through the local BPF 75 at a mixer 69. The output of the mixer 69 passes through a BPF 70, driver 71, and BPF 72. Its power is amplified by a power amplifier 73, and then transmitted from the antenna 61 through the antenna duplexer 62.

The dielectric filter of the present invention is effectively applicable to the antenna duplexer 62, BPF 64 of the receiver section 76, BPFs 70 and 72 of the transmitter section 77, and local BPF 75 of the local oscillator 74. This achieves the smaller RF section with higher performance.

Since even in low frequency bands (from VHF to UHF) the filter of the present invention is smaller than that of the prior art, it is also effectively applicable to RF apparatuses (TVs, radios, industrial RF units such as for taxis), and broadcasting equipment using such frequency bands.

Without being limited to RF apparatuses, the dielectric filter of the present invention demonstrates good effects by applying it to a range of high frequency circuits operating at frequency bands above VHF requiring small size.

FIG.6 shows a representative example of a block diagram of a RF apparatus provided with both transmitter section and receiver section. It is apparent that it is also applicable to RF apparatuses provided with either transmitter section or receiver section only.

As described above, the dielectric filter of the present invention enables a significant shortening of resonator length, thus realizing a far smaller filter than the conventional structure.

Since the connections between the inside conductor and in-groove conductor are formed inside the outside conductor, radiation electric field leakage to the outside of the outside conductor is preventable, securing a high no-load Q of the resonator. This enables a low-loss configured filter.

Since small resonators generate multiple resonance frequencies which are not an odd-numbered multiple of the fundamental frequency, a dielectric filter which efficiently suppresses the generation of higher harmonic, which may occur in non-linear devices such as power amplifiers, is achievable.

Furthermore, the present invention enables the integral molding of the dielectric block with through holes and grooves. More specifically, since the connection of the inside conductor and in-groove conductor is formed inside the open-circuit end, dielectric ceramics may be sintered in one piece using molds. The filter is easily manufactured by coated with a metal film to the entire face of the dielectric ceramic material and grinding the open-circuit end, thus making it suitable for low-cost mass production.

The dielectric filter of the present invention provides the significant advantage in making equipment smaller when applied to a range of high frequency circuits and RF apparatuses such as broadcasting equipment which operate at frequencies above VHF and in which small size is desirable.

What is claimed is:

1. A dielectric filter comprising:

a dielectric block having a plurality of through holes formed in parallel with a respective groove surrounding a respective opening of at least one of said through holes, an in-groove conductor formed inside said groove;

an inside conductor formed inside each of said through holes;

an outside conductor covering a periphery of said dielectric block; and an I/O electrode connected to an external circuit and electromagnetically coupled with said inside conductor;

wherein at least one of said through holes has no groove surrounding said through hole, said outside conductor and said inside conductor are connected, and said in-groove conductor and said inside conductor are connected.

2. The dielectric filter as defined in claim 1, wherein said respective opening surrounded by said respective groove is formed inside a first end of said dielectric block.

3. The dielectric filter as defined in claim 1, wherein said groove is formed concentric to said one of said through holes.

4. The dielectric filter as defined in claim 2, wherein said groove is formed concentric to said one of said through holes.

5. The dielectric filter as defined in claim 1, wherein said groove is formed in parallel to the periphery of said dielectric block.

6. The dielectric filter as defined in claim 2, wherein said groove is formed in parallel to the periphery of said dielectric block.

7. The dielectric filter as defined in claim 1, wherein at least two of said grooves are formed, surrounding said respective opening of at least one of said through holes.

8. The dielectric filter as defined in claim 2, wherein at least two of said grooves are formed, surrounding said respective opening of at least one of said through holes.

9. The dielectric filter as defined in claim 1, wherein said groove is tapered.

10. The dielectric filter as defined in claim 1, wherein the depth of said groove is different for each of said through holes.

11. The dielectric filter as defined in claim 9, wherein the depth of said groove is different for each of said through holes.

12. The dielectric filter as defined in claim 1, wherein the width of said groove is different for each of said through holes.

13. The dielectric filter as defined in claim 9, wherein the width of said groove is different for each of said through holes.

14. The dielectric filter as defined in claim 9, wherein the width of said groove is different for each of said through holes.

15. A dielectric filter comprising:

a dielectric block having first and second ends and having a plurality of through holes formed in parallel in said dielectric block, said through holes having an opening on each of said first and second ends;

at least one groove formed on said first end of said dielectric block, said groove being formed surrounding at least one of said through holes;

an in-groove conductor inside said groove;

an inside conductor inside each of said through holes, said inside conductor being connected to said in-groove conductor at the opening of said through hole surrounded with said groove;

an outside conductor covering the periphery of said dielectric block, said outside conductor being connected to said inside conductor at said second end having the opening of each of said through hole; and an I/O electrode electromagnetically coupled with said inside conductor wherein at least one of said through holes has no groove surrounding said through hole.

16. The dielectric filter as defined in claim 15, wherein said groove is formed inside said first end.

17. A RF apparatus employing the dielectric filter comprising:

a dielectric block having a plurality of through holes formed in parallel in said dielectric block; and at least one groove surrounding a respective opening of at least one of said through holes;

an in-groove conductor inside said groove;

an inside conductor inside each of said through holes;

an outside conductor covering a periphery of said dielectric block; and an I/O electrode connected to an external circuit and electromagnetically coupled with said inside conductor;

wherein said outside conductor and said inside conductor are connected, at least one of said through holes has no groove surrounding said through hole, and said in-groove conductor and said inside conductor are connected.

18. The dielectric filter as defined in claim 2, wherein said groove is tapered.

19. The dielectric filter as defined in claim 3, wherein said groove is tapered.

20. The dielectric filter as defined in claim 4, wherein said groove is tapered.

21. The dielectric filter as defined in claim 5, wherein said groove is tapered.

22. The dielectric filter as defined in claim 6, wherein said groove is tapered.

23. The dielectric filter as defined in claim 7, wherein said groove is tapered.

24. The dielectric filter as defined in claim 8, wherein said groove is tapered.

25. The dielectric filter as defined in claim 2, wherein the depth of said groove is different for each of said through holes.

26. The dielectric filter as defined in claim 3, wherein the depth of said groove is different for each of said through holes.

27. The dielectric filter as defined in claim 4, wherein the depth of said groove is different for each of said through holes.

28. The dielectric filter as defined in claim 5, wherein the depth of said groove is different for each of said through holes.

29. The dielectric filter as defined in claim 6, wherein the depth of said groove is different for each of said through holes.

30. The dielectric filter as defined in claim 7, wherein the depth of said groove is different for each of said through holes.

31. The dielectric filter as defined in claim 8, wherein the depth of said groove is different for each of said through holes.

32. The dielectric filter as defined in claim 2, wherein the width of said groove is different for each of said through holes.

33. The dielectric filter as defined in claim 3, wherein the width of said groove is different for each of said through holes.

34. The dielectric filter as defined in claim 4, wherein the width of said groove is different for each of said through holes.

35. The dielectric filter as defined in claim 5, wherein the width of said groove is different for each of said through holes.

36. The dielectric filter as defined in claim 6, wherein the width of said groove is different for each of said through holes.

37. The dielectric filter as defined in claim 7, wherein the width of said groove is different for each of said through holes.

38. The dielectric filter as defined in claim 8, wherein the width of said groove is different for each of said through holes.

* * * * *